3/31/87 XR 4,653,597

United States Patent [19]

Johnson

[11] Patent Number: 4,653,597

[45] Date of Patent: Mar. 31, 1987

[54] METHOD FOR CIRCULATING AND MAINTAINING DRILLING MUD IN A WELLBORE

[75] Inventor: Albert S. Johnson, Parker, Colo.

[73] Assignee: Atlantic Richfield Company, Los Angeles, Calif.

[21] Appl. No.: 804,722

[22] Filed: Dec. 5, 1985

[51] Int. Cl.[4] ..... E21B 21/08

[52] U.S. Cl. ..... 175/25; 175/38; 175/48

[58] Field of Search ..... 175/25, 38, 48, 65, 175/70; 299/2

[56] References Cited

U.S. PATENT DOCUMENTS

| | | | |
|---|---|---|---|
| 4,165,903 | 8/1979 | Cobbs | 299/2 |
| 4,458,945 | 7/1984 | Ayler et al. | 299/2 |
| 4,534,427 | 8/1985 | Wang et al. | 175/70 |
| 4,535,851 | 8/1985 | Kirkpatrick et al. | 175/38 |

*Primary Examiner*—Stephen J. Novosad
*Assistant Examiner*—William P. Neuder
*Attorney, Agent, or Firm*—F. Lindsey Scott

[57] ABSTRACT

A method for circulating and maintaining a drilling mud in a wellbore drilled into a subterranean formation at a desired pressure during drilling operations, said method consisting essentially of;

(a) circulating drilling mud through a drill pipe in the wellbore into the wellbore, maintaining a desired pressure in said wellbore and recovering drilling mud from the wellbore at a controlled rate using a mud pump and mud pit arrangement; and, (b) maintaining a second supply of drilling mud in fluid communication with the drill pipe at a suitable pressure so that when the mud pump fails to maintain pressure in the drill pipe, drilling mud is supplied from the second supply of drilling mud to maintain pressure in the wellbore.

10 Claims, 3 Drawing Figures

METHOD FOR CIRCULATING AND MAINTAINING DRILLING MUD IN A WELLBORE

This invention relates to methods for circulating and maintaining drilling mud in a wellbore at a desired pressure during drilling operations wherein a wellbore is drilled into a subterranean formation from a subterranean access cavity.

A variety of systems for circulating and maintaining drilling mud in a wellbore during drilling operations are well known to those skilled in the art as a result of the use of drilling muds for many years to control blowouts, remove cuttings from wellbores and the like as commonly practiced in the petroleum industry. In recent years, there has been increased interest in reaching difficultly accessible formations which may contain petroleum or other mineral values by drilling to reach such formations from subterranean tunnels positioned near, i.e., above or below the formation containing the petroleum or other mineral of interest. In the drilling of such wells, many problems common to the drilling of similar wells from the surface are encountered, such as zones of high pressure gas, zones of high pressure liquids, such as water or petroleum and the like. It is also necessary to remove cuttings from the wellbore by some method. As a result, it is desirable that drilling mud be circulated through the wellbore in much the same manner as for wells drilled from the surface during such drilling operations from subterranean tunnels or other access cavities.

One problem which is unique to such drilling operations is that where wells are drilled upwardly from the subterranean access cavity to reach a formation above the access cavity the well is inverted by comparison to similar drilling operations from the surface. When circulation is lost or the drilling mud pump ceases to operate during surface operations, it is not difficult to maintain a hydrostatic pressure in the wellbore as a result of the height and density of drilling mud in the wellbore. Such considerations do not apply when the well is inverted since if pressure or circulation is lost, the drilling mud tends to flow from the well. The loss of the drilling mud (and pressure which is desirably maintained in the well by the drilling mud) as a result of any such lost circulation or pump failure can be detrimental to the drilling operation. In other words, if the circulation or pressure is lost during a time when liquids or gases under high pressure or in large volume are in fluid communication with the wellbore from a subterranean formation penetrated by the wellbore the result may be a blow-out. Clearly, it is desirable that the drilling mud be maintained at the required pressure in the wellbore at all times.

Another problem arises in such operations when wells are drilled into a formation beneath the subterranean access cavity because of the reduced depth of the wells. When wells are drilled from the surface a suitable pressure can be maintained in the wells by the hydrostatic pressure in the wellbore as a result of the height and density of drilling mud in the wellbore. As a result of the use of a subterranean access cavity the wells do not extend to the surface and the pressure which can be maintained by hydrostatic pressure as a result of drilling mud in the wellbore is less than the formation pressure until the wells reach a depth sufficient to compensate for the reduced depth by adjustments in the density of the drilling mud. In most instances, the subterranean access cavities are located relatively near the formation of interest so that the wells are not of sufficient depth to permit the maintenance of a desired pressure in the wellbore by hydrostatic pressure. Since zones of high pressure gas or liquid can be encountered at any time during drilling operations, it is desirable that the drilling mud be maintained in the wellbore at the required pressure at all times.

Accordingly, a continuing effort has been directed to the development of methods whereby drilling mud may be continuously maintained in a wellbore drilled from a subterranean access cavity at a desired pressure during drilling operations.

According to the present invention, drilling mud is circulated and maintained in a wellbore drilled from a subterranean access cavity into a subterranean formation at a desired pressure during drilling operations by a method consisting essentially of:

(a) circulating the drilling mud through a drill pipe in the wellbore into the wellbore, maintaining a desired pressure in the wellbore and recovering the drilling mud from the wellbore at a controlled rate using a mud pump and mud pit arrangement; and, (b) maintaining a second supply of drilling mud in fluid communication with the drill pipe at a suitable pressure so that when the mud pump fails to maintain pressure in the drill pipe, drilling mud is supplied from the second supply of drilling mud to maintain pressure in the wellbore.

In the discussion of the Figures, the same numbers will be used to refer to the same or similar components throughout.

Figure 1:
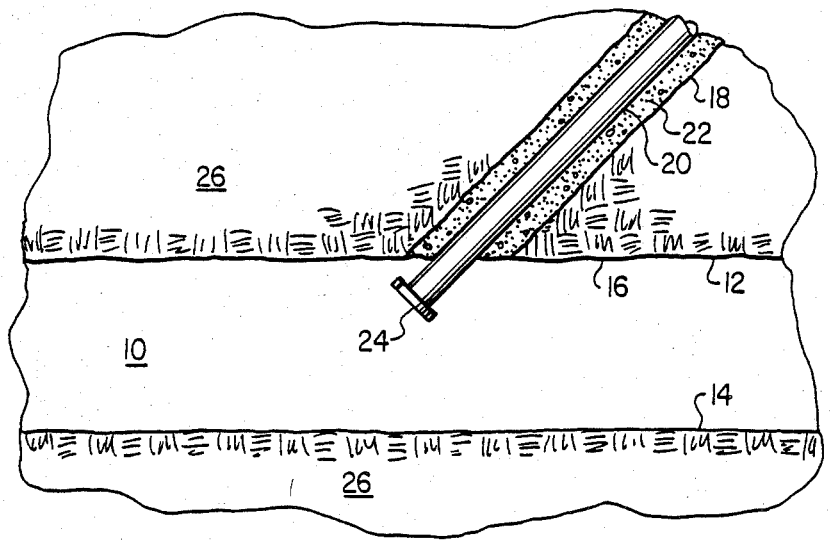
FIG. 1 is a schematic diagram of a tunnel positioned beneath a subterranean formation penetrated by a conductor pipe which has been cemented in place.

In FIG. 1, a tunnel 10 positioned beneath a subterranean formation 26 is shown. A tunnel lining 16, as known to those skilled in the art, is shown at both the top 12 and the bottom 14 of tunnel 10. A conductor pipe 20 is positioned in a wellbore 18 and cemented in place with cement 22. A flange 24 is positioned on an end of conductor pipe 20 which extends a short distance into tunnel 10. The installation of such conductor pipes for the drilling of subsequent wells may be accomplished as a part of the tunnel construction if desired. While conductor pipe 20 is shown extending upwardly at an angle of about 45° from vertical in FIG. 1, it should be understood that such wells could be drilled substantially vertically upwardly or downwardly or at substantially any angle from tunnel 10.

Figure 2:
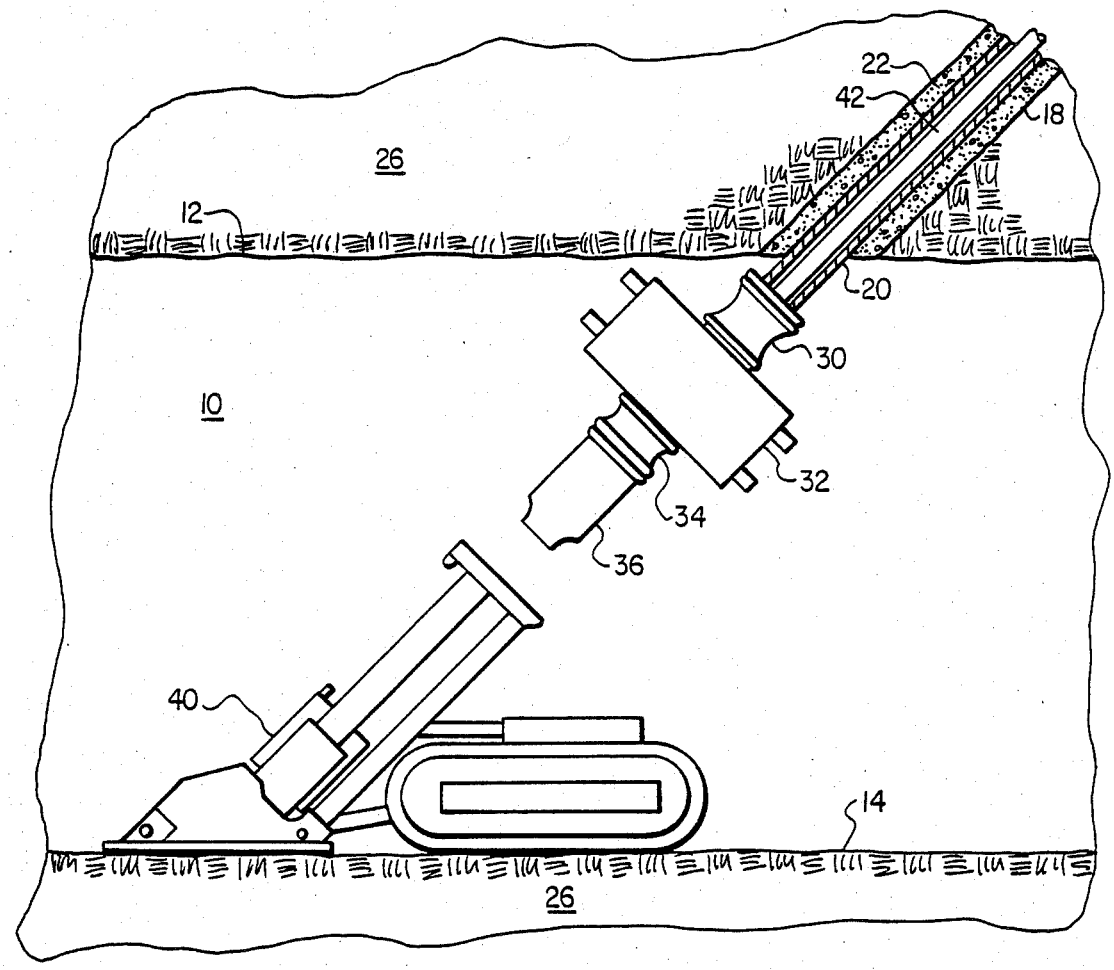
FIG. 2 is a schematic diagram of a drilling apparatus positioned to drill into a subterranean formation through the conductor pipe shown in FIG. 1.

In FIG. 2, a rotary drill 40 is shown positioned in tunnel 10. Conductor pipe 20 has been fitted with a casing head 30, a blow-out preventer 32, a drilling spool 34, and a rotating blow-out preventer 36. A drill pipe 42 has been positioned through conductor pipe 20 for the conduct of drilling operations. The various items of equipment discussed are considered to be well known to those skilled in the art and are available from a variety of commercial sources. No further discussion of the particular drilling equipment used is considered necessary.

Figure 3:
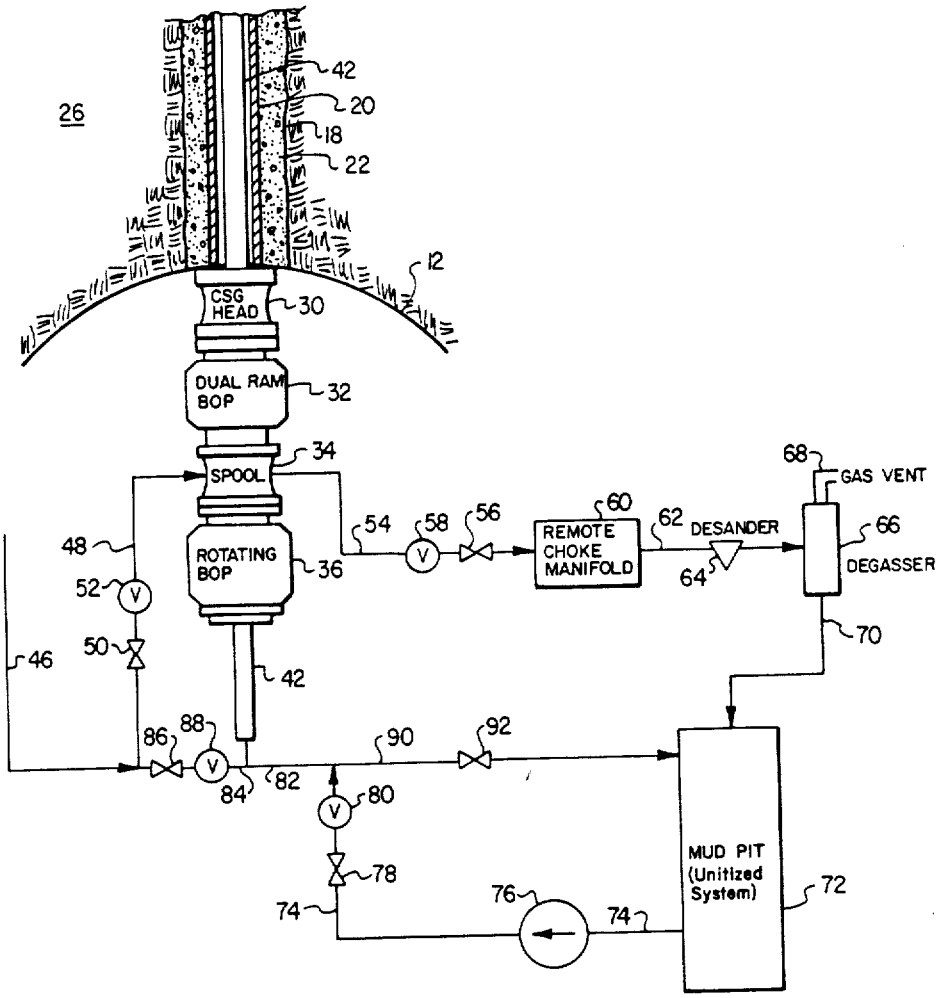
FIG. 3 is a schematic diagram of an embodiment of the present invention.

In FIG. 3, a schematic diagram of a system for accomplishing the circulation and maintenance of drilling mud in a wellbore drilled upwardly into a subterranean formation is shown. The drilling equipment shown, including the pipes penetrating subterranean formation 26, is substantially as shown in FIG. 2. Drilling mud is supplied to the system at a required pressure through a line 46 which is in fluid communication with a source of drilling mud which may be, and desirably is, at the surface. The surface supply of drilling mud mav be sufficient to supply a number of drilling operations in subterranean cavities. Line 46 is in fluid communication with a line 48 which includes a valve 50, a check valve 52, and is in fluid communication with conductor pipe 20 via spool 34. Line 46 is also in fluid communication with a line 84 which includes a valve 86 and a check valve 88. Line 84 is in fluid communication with drill pipe 42. A line 54 including a valve 56 and a check valve 58, provides fluid communication between the annular space between the outer diameter of drill pipe 42 and the inner diameter of conductor pipe 20 and wellbore 18 and a remote choke manifold 60. Choke manifold 60 permits the flow of drilling mud from the annular space between drill pipe 42 and the inner diameter of conducter pipe 20 while maintaining a desired back pressure on the drilling mud in the annular space. Drilling mud is passed from choke manifold 60 at substantially atmospheric pressure via a line 62 through a desander 64 for the removal of particulate solids and to a degasser 66. Gases which may be dissolved in the drilling mud are separated in degasser 66 and vented to suitable handling and recovery via a gas vent 68. The degassed drilling mud is then passed via a line 70 to a mud pit 72. Mud pit 72 basically serves as a holding area for a drilling mud inventory and as a first and primary source of drilling mud for the system. Since mud pit 72 is at substantially atmospheric pressure, it can comprise an open vessel and the desanding and degassing operations can be performed as known to the art for surface drilling operations. A line 74 is in fluid communication with mud pit 72 and a drilling mud pump 76 for the withdrawal of drilling mud from mud pit 72. Drilling mud is pumped through line 74 which includes a valve 78, and a check valve 80 to a line 82 which is in fluid communication with drill pipe 42. Line 74 is also in fluid communication with a line 90 which includes a valve 92 and is in fluid communication with mud pit 72.

In the operation of the apparatus described above, the drill bit is positioned immediately beneath blow-out preventer 32 and rotating blow-out preventor 36 is made operational by installing stripping rubber, etc. as known to the art. Valves 50 and 56 are then opened with valve 86 being closed. Drilling mud is then injected into the system and the system is pressurized by the flow of drilling mud through lines 46, 48 and 54 and into conductor pipe 20. After a selected pressure has been reached, choke manifold 60 permits the flow of drilling mud through manifold 60, line 62, degasser 66, line 70 and into mud pit 72. An inventory of drilling mud in mud pit 72 can be established in this manner. Alternatively, drilling mud can be added to mud pit 72 by a variety of means. The particular method of initially charging a desired quantity of drilling mud to mud pit 72 is considered to be well within the skill of those in the art and does not constitute a part of the present invention.

Mud pump 76 is then started to establish circulation of drilling mud through lines 74 and 90. After circulation is established, valves 50 and 92 are closed and drilling mud is pumped into drill pipe 42 via line 82. The drilling mud flows through drill pipe 42 into wellbore 18, through the annular space between the outer diameter of drill pipe 42 and the inner diameter of conductor pipe 20, through spool 34 and into line 54. After circulation of drilling mud has been established in the system using pump 76, valve 86 is opened so that upon any loss of circulation or loss of pressure in the system as maintained by pump 76, drilling mud can flow from line 46 through check valve 88 as required to maintain drilling mud in the wellbore. Check valve 88 prevents the flow of drilling mud in a reverse direction during normal drilling operations. This immediate availability of drilling mud at a required pressure from a second source via line 46 ensures that drilling mud can be maintained in conductor pipe 20 and wellbore 18 at a required pressure at all times.

While an embodiment for drilling upwardly from a subterranean access cavity has been shown, it should be understood that the present method for circulating and maintaining drilling mud at a desired pressure in a wellbore drilled from a subterranean access cavity is equally applicable to wellbores drilled upwardly, downwardly or at any angle from a subterranean access cavity. The practice of the method is substantially the same as discussed above for such variations of the method.

When it is necessary to add a joint of drill pipe in the embodiment shown in FIG. 3, valve 86 is closed, valve 50 is opened and pump 76 is shut down. A check valve (not shown) is included in the end of drill pipe 42 near the bit (not shown) to ensure that drilling mud cannot flow from the wellbore or the annulus between the outer diameter of drill pipe 42 and the inner diameter of conductor pipe 20 into drill pipe 42. When valve 50 is opened and valve 86 is closed, drilling mud at a required pressure remains in contact with the annular space between the outer diameter of drill pipe 42 and the inner diameter of conductor pipe 20. When the wellbore extends upwardly from the access cavity, valve 92 is then opened and drilling mud is allowed to drain from drill pipe 42 into mud pit 72 so that an additional length of drill pipe can be added. Such draining is unnecessary when the wellbore extends downwardly from the access cavity. The resumption of drilling after addition of the section of drill pipe is accomplished by closing valve 92 (if opened for drainage) and engaging pump 76. As soon as circulation is established using pump 76, valve 86 is opened and valve 50 is closed. The drilling operation is then continued as described previously.

Desirably, the second source supply of drilling mud furnished through line 46 is from the surface or at least from some remote location. Preferably, the location is at the surface so that a desired pressure can be maintained in the form of a hydrostatic head of drilling mud of a selected density without the need for additional pumps, etc. Various instrumentation (not shown) to monitor the pressure and flow rates in the various lines may be included in the system as known to those skilled in the art. The use of suitable pressure, and flow rate instruments as well as instrumentation for determining the temperature and the like is considered to be known to those skilled in the art. The amount and types of such instrumentation is not considered to constitute a part of the present invention.

In the practice of the present invention, it is advantageous to have instrumentation available at the drilling site to determine whether drilling mud is being lost into the formation. Such information permits detection of the escape of drilling mud into the formation and permits the operator to take appropriate means to prevent the loss of drilling mud. Such means for preventing the loss of drilling mud are well known to those skilled in the art and include the incorporation of fibrous or particulate matter into the drilling mud to plug porous zones of the formation, etc. While a ready supply of abundant quantities of drilling mud is available from the surface through line 46, it is still desirable that the operator at the drill site be able to detect and remedy conditions which result in the loss of drilling mud to the formation.

While a single conductor pipe 20 is shown, it is pointed out that a plurality of conductor pipes or casings of decreasing size could be installed and cemented in place as a part of the drilling operation. Many such variations are known to those skilled in the art for drilling wellbores in various subterranean environments.

Having thus described the present invention by reference to certain of its preferred embodiments, it is respectfully pointed out that many variations and modifications are possible within the scope of the present invention. Many such variations and modifications may be considered obvious and desirable to those skilled in the art based upon a review of the foregoing description of preferred embodiments.

Having thus described the invention, I claim:

1. A method for circulating and maintaining a drilling mud in a wellbore at a desired pressure during drilling operations, said wellbore being drilled into a subterranean formation from a subterranean access cavity, said method consisting essentially of;

(a) circulating said drilling mud from a first supply of drilling mud located in said access cavity through a drill pipe in said wellbore into said wellbore, maintaining a desired pressure in said wellbore and recovering said drilling mud from said wellbore at a controlled rate using a mud pump and mud pit arrangement located in said access cavity; and, (b) maintaining a second supply of drilling mud, said second supply of drilling mud being located at the surface, in fluid communication with said drill pipe at a suitable pressure so that when said mud pump fails to maintain pressure in said drill pipe, drilling mud is supplied from said second supply of drilling mud to maintain pressure in said drill pipe wherein said pressure in said drilling mud from said second supply is maintained by the hydrostatic pressure resulting from the density of said drilling mud and the height of the column of drilling mud extending from said subterranean formation to the surface.

2. The method of claim 1 wherein drilling mud is supplied to said mud pump and pit arrangement from said second supply of drilling mud.

3. The method of claim 1 wherein make-up drilling mud is supplied to said mud pump and pit arrangement from said second supply of drilling mud.

4. The method of claim 1 wherein said second supply of drilling mud is in fluid communication with said drill pipe via a check valve.

5. The method of claim 1 wherein sections are added to said drill pipe as required by reducing the pressure in said drill pipe while maintaining the pressure in said wellbore by maintaining said second supply of drilling mud in fluid communication with said wellbore and restricting the flow of drilling mud from said wellbore into said drill pipe.

6. The method of claim 5 wherein a check valve in said drill pipe is used to restrict the flow of said drilling mud from said wellbore into said drill pipe.

7. The method of claim 1 wherein said subterranean access cavity is positioned beneath said subterranean formation and wherein said wellbore is drilled upwardly into said subterranean formation.

8. The method of claim 1 wherein said subterranean access cavity is positioned above said subterranean formation and wherein said wellbore is drilled downwardly into said subterranean formation.

9. A method for circulating and maintaining a drilling mud in a wellbore at a desired pressure during drilling operations, said wellbore being drilled into a subterranean formation from an access cavity positioned beneath said subterranean formation, said method consisting essentially of;

(a) circulating said drilling mud through a drill pipe in said wellbore into said wellbore, maintaining a desired pressure in said wellbore and recovering said drilling mud from said wellbore at a controlled rate using a mud pump and mud pit arrangement; and, (b) maintaining a second supply of drilling mud in fluid communication with said drill pipe at a suitable pressure so that when said mud pump fails to maintain pressure in said drill pipe, drilling mud is supplied from said second supply of drilling mud to maintain pressure in said drill pipe;

wherein sections are added to said drill pipe as required by reducing the pressure in said drill pipe while maintaining the pressure in said wellbore by maintaining said second supply of drilling mud in fluid communication with said wellbore and restricting the flow of drilling mud from said wellbore into said drill pipe.

10. A method for circulating and maintaining a drilling mud in a wellbore at a desired pressure during drilling operations, said wellbore being drilled into a subterranean formation from an access cavity positioned beneath said subterranean formation, said method consisting essentially of;

(a) circulating said drilling mud through a drill pipe in said wellbore into said wellbore, maintaining a desired pressure in said wellbore and recovering said drilling mud from said wellbore at a controlled rate using a mud pump and mud pit arrangement; and, (b) maintaining a second supply of drilling mud in fluid communication with said drill pipe at a suitable pressure so that when said mud pump fails to maintain pressure in said drill pipe, drilling mud is supplied from said second supply of drilling mud to maintain pressure in said drill pipe;

wherein sections are added to said drill pipe as required by reducing the pressure in said drill pipe while maintaining the pressure in said wellbore by maintaining said second supply of drilling mud in fluid communication with said wellbore and restricting the flow of drilling mud from said wellbore into said drill pipe and wherein a check valve in said drill pipe is used to restrict the flow of said drilling mud from said wellbore into said drill pipe.

* * * * *

UNITED STATES PATENT AND TRADEMARK OFFICE

CERTIFICATE OF CORRECTION

PATENT NO. : 4,653,597

DATED : March 31, 1987

INVENTOR(S) : Albert S. Johnson

It is certified that error appears in the above-identified patent and that said Letters Patent is hereby corrected as shown below:

Figure 3 of the drawings should be added as shown on the attached sheet.

Signed and Sealed this

Eleventh Day of August, 1987

*Attest:*

DONALD J. QUIGG

*Attesting Officer*

*Commissioner of Patents and Trademarks*